US008033847B1

(12) United States Patent
Chen

(10) Patent No.: US 8,033,847 B1
(45) Date of Patent: Oct. 11, 2011

(54) POWER ADAPTER HAVING A REPLACEABLE AND POSITIONABLE PLUG

(75) Inventor: Kuan-Chih Chen, Hsin-Tien (TW)

(73) Assignee: Leader Electronics Inc.

( * ) Notice: Subject to any disclaimer, the term of this patent is extended or adjusted under 35 U.S.C. 154(b) by 0 days.

(21) Appl. No.: 12/949,576

(22) Filed: Nov. 18, 2010

(51) Int. Cl.
*H01R 29/00* (2006.01)

(52) U.S. Cl. ..... 439/172

(58) Field of Classification Search ..... 439/172, 439/518, 640
See application file for complete search history.

(56) References Cited

U.S. PATENT DOCUMENTS

| | | | | |
|---|---|---|---|---|
| 6,320,353 | B1 | 11/2001 | Chiu et al. | |
| 7,168,968 | B1 * | 1/2007 | Li | 439/172 |
| 7,168,969 | B1 | 1/2007 | Wang | |
| 7,232,322 | B1 * | 6/2007 | Yen et al. | 439/222 |
| 7,946,868 | B1 * | 5/2011 | Chen | 439/173 |
| 2007/0032109 | A1 * | 2/2007 | Hung | 439/172 |

FOREIGN PATENT DOCUMENTS

| | | |
|---|---|---|
| DE | 101 030 679 | 8/2002 |
| WO | WO 97/09764 | 3/1997 |

OTHER PUBLICATIONS

U.S. Appl. No. 12/621,630.

* cited by examiner

*Primary Examiner* — Phuong Dinh
(74) *Attorney, Agent, or Firm* — Hershkovitz & Associates LLC; Abraham Hershkovitz

(57) ABSTRACT

A power adapter having a replaceable and positionable plug has a body and a plug. The body has two conducting terminals and a ground terminal mounted on a top of the body. The plug has a ground hole and multiple arced holes mounted through a bottom thereof, an intermediate ground assembly and two intermediate conducting clip assemblies mounted in the plug and respectively corresponding to the ground hole and the arced holes, and a ground pin and two conducting pins mounted on a top thereof and respectively and electrically connected with the intermediate ground assembly and the intermediate conducting clip assemblies. When the plug is assembled with the body, the ground terminal and the conducting terminals are electrically connected with the ground pin and the conducting pins respectively inserted into the ground hole and selectively into the corresponding arced holes. With the structure, the plug is replaceable and positionable.

20 Claims, 10 Drawing Sheets

POWER ADAPTER HAVING A REPLACEABLE AND POSITIONABLE PLUG

BACKGROUND OF THE INVENTION

1. Field of the Invention

The present invention relates to a power adapter, and more particularly to a power adapter having a replaceable and positionable plug.

2. Description of the Related Art

People cannot live without electric appliances in contemporary life. Both electric appliances and chargers for electric appliances need to be equipped with a power plug plugged in a power outlet to acquire an operating power therefor. Besides wallmount power outlet, a power plug can be plugged in a receptacle of an extension power cord. As the power plugs of the electric appliances and chargers usually have circuits or transformer in the plugs, the sizes of the power plugs tend to be relatively bulky. Therefore, when being plugged in a power outlet, the power plugs easily block other receptacles of the power outlet, prevent other plugs from being plugged in, and limit the number of the receptacles in use.

SUMMARY OF THE INVENTION

An objective of the present invention is to provide a power adapter having a replaceable and positionable plug.

To achieve the foregoing objective, the power adapter having a replaceable and positionable plug has a body and a plug.

The body has a top, a bottom, a first indentation, a ground terminal and two conducting terminals. The first indentation is circularly formed in the top of the body and having a bottom and a sidewall. The ground terminal is mounted on the bottom of the first indentation and is electrically conductive. The conducting terminals are mounted on the bottom of the first indentation, and are electrically conductive.

The plug is hollow and has a top, a bottom, a cylinder, a ground hole and multiple arced holes, two intermediate conducting clip assemblies and two conducting pins. The cylinder is formed on and protrudes from the bottom of the plug, received in the first indentation, and having a bottom and a cylindrical surface. The ground hole is centrally formed through the cylinder and inserted in by the ground terminal of the body. The arced holes are formed through the bottom of the cylinder, and arranged in a circle with respect to the ground hole. Two of the arced holes are selectively inserted in by the conducting terminals. The intermediate conducting clip assemblies are mounted inside the plug, and respectively and electrically connected with the conducting terminals of the body. The conducting pins are formed through the top of the body. One end of each one of the conducting pins is mounted in the plug to electrically connect with one of the intermediate conducting clip assemblies.

When the plug is assembled with the body, the ground terminal and the conducting terminals on the body are respectively inserted into the ground hole and selectively into two of the arced holes, and are respectively and electrically connected with the ground pin and the conducting pins. Regardless of which pair of arced holes is inserted in by the conducting terminals, the conducting terminals can be electrically and respectively connected with the conducting pins. Accordingly, the aforementioned structure allows the plug to be replaced with a plug with a different specification and positioned at a desired orientation.

Other objectives, advantages and novel features of the invention will become more apparent from the following detailed description when taken in conjunction with the accompanying drawings.

DETAILED DESCRIPTION OF THE INVENTION

Figure 1:
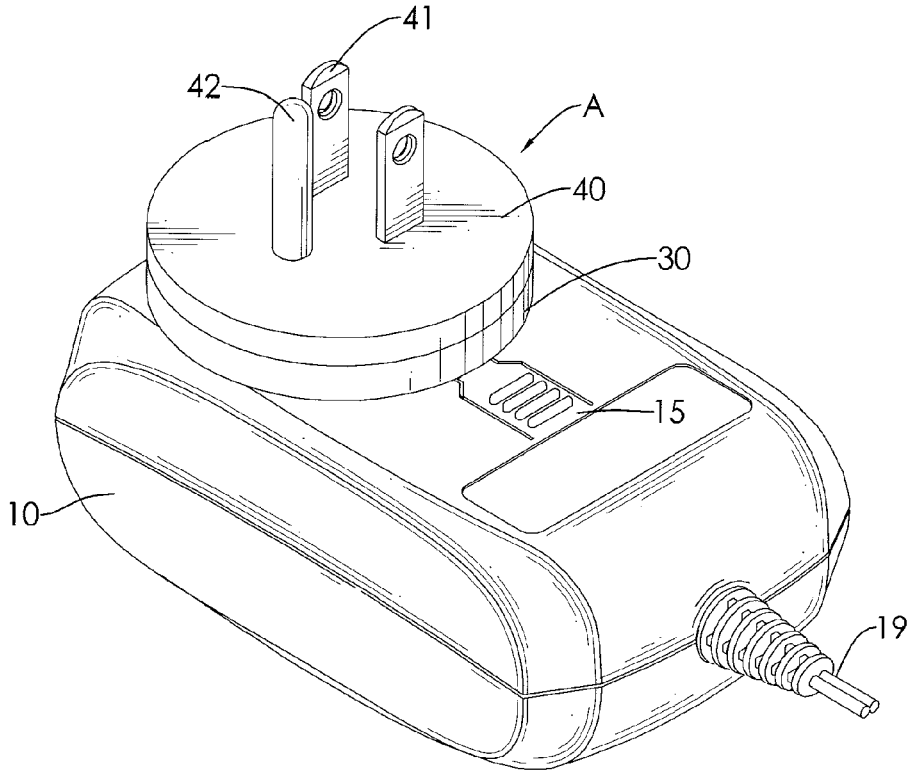
FIG. 1 is a perspective view of a first embodiment of a power adapter having a replaceable and positionable plug in accordance with the present invention.
Figure 2:
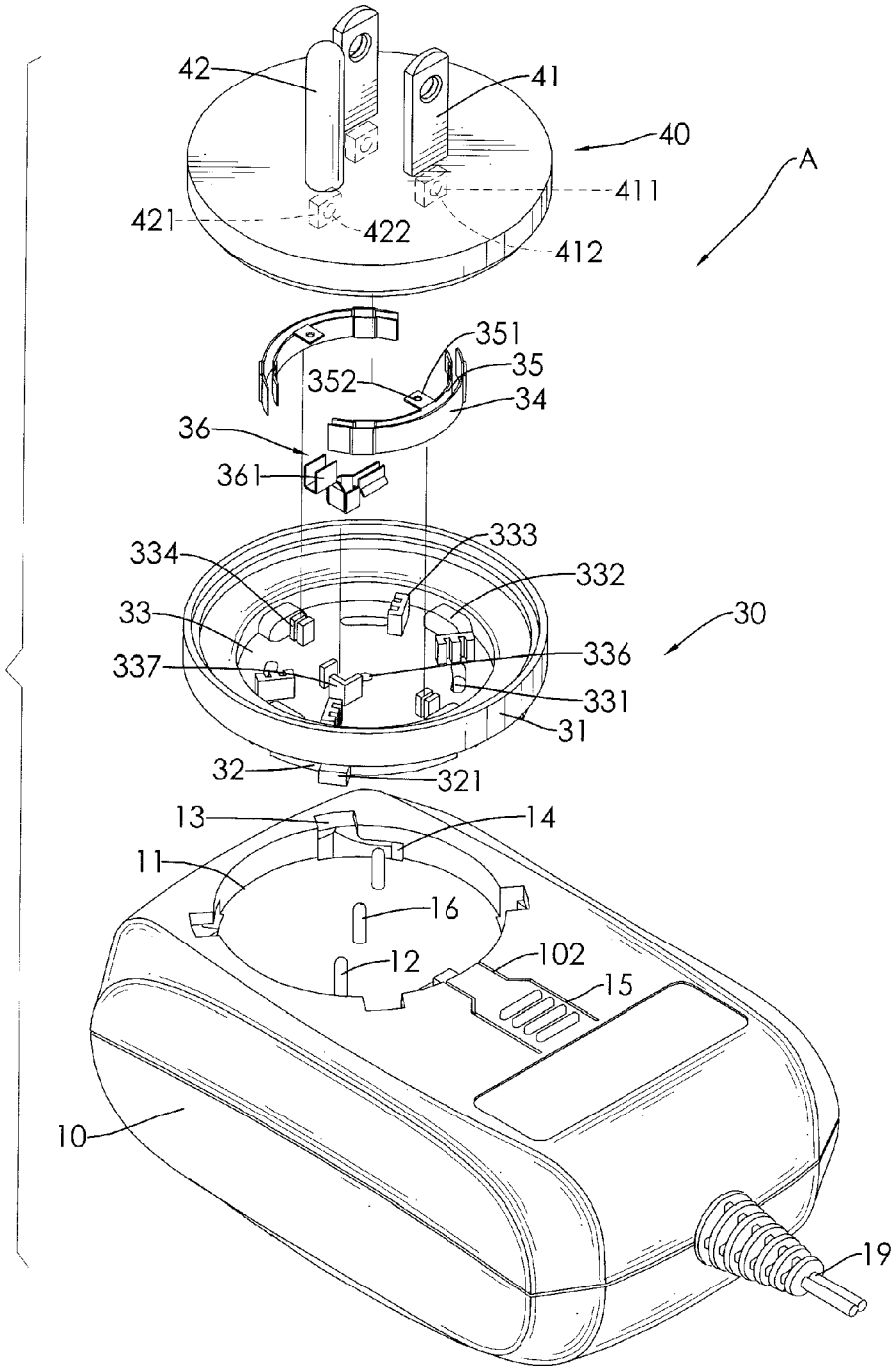
FIG. 2 is an exploded perspective view of the power adapter in FIG. 1.

With reference to FIGS. 1 and 2, a first embodiment of a power adapter having a replaceable and positionable plug in accordance with the present invention has a body 10 and a plug (A). The body 10 has a power conversion unit, a first indentation 11, a ground terminal 16, two conducting terminals 12, multiple slidable grooves 13, a release tongue 15, and a power cable 19. The power conversion unit is mounted inside the body 10 and serves to convert an input power into an operating power to an electric appliance connected with the power adapter. The first indentation 11 is circularly formed in a top of the body 10. The ground terminal 16 is centrally mounted on a bottom of the first indentation 11, and the conducting terminals 12 are oppositely mounted on the bottom of the first indentation 11. The ground terminal 16 and the conducting terminals 12 are electrically connected with the power conversion unit. The slidable grooves 13 are formed in a sidewall of the first indentation 11. Each one of the slidable grooves 13 has an engagement recess 14 formed in one end of the slidable groove 13.

Figure 3:
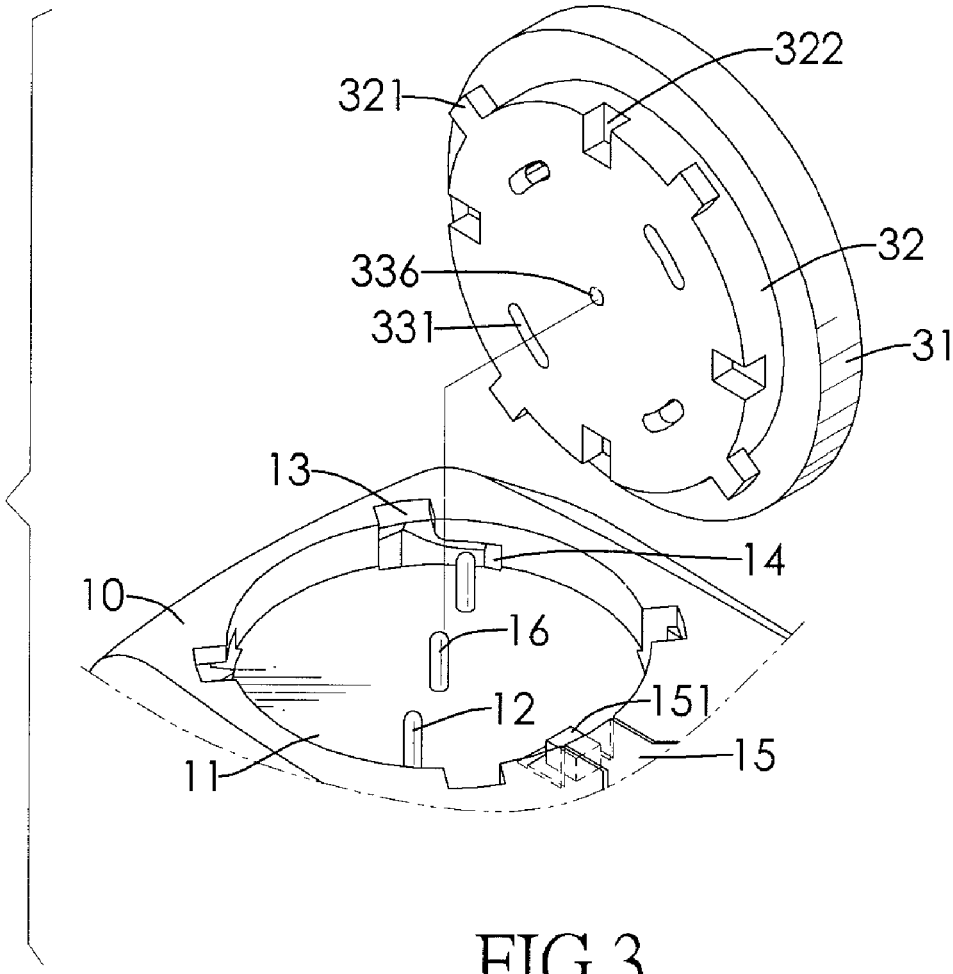
FIG. 3 is an enlarged exploded perspective view of the power adapter in FIG. 1.

The release tongue 15 is formed by cutting two slits 102 into the top of the body and extending the slits 102 to meet on the bottom of the first indentation 11 so as to form a free end inside the first indentation 11. With further reference to FIG. 3, the release tongue 15 has an engagement block 151 formed on and protruding from the free end. The power cable 19 is electrically connected with the power conversion unit inside the body 10.

With reference to FIGS. 1, 2, 3 and 6, the plug (A) is hollow, cylindrical and flat, and has a base 30 and a cover 40.

The base 30 has a fence 31, a cylinder 32, a second indentation 33, two intermediate conducting clip assemblies and an intermediate ground assembly 36. The fence 31 is annularly formed on and protrudes from a perimeter of a top of the base 30. The cylinder 32 is formed on and protrudes from a bottom of the base 30, and is received in the first indentation 11. The second indentation 33 is formed in the top of the base 30 and recessed into the cylinder 32. The second indentation 33 has a ground hole 336, four arced holes 331, four locating pieces 333, two plate guides 334 and two stoppers 337. The ground hole 336 is centrally formed through a bottom of the second indentation 33 and is inserted in by the ground terminal 16 of the body 10. The arced holes 331 are formed through the bottom of the second indentation 33, are arranged in a circle with respect to the ground hole 336 and are grouped as two pairs. Each pair of the arced holes 331 has a first arced hole and a second arced hole. The first arced hole of one pair of the arced holes 331 and the second arced hole of the other pair of the arced holes are oppositely located, and are respectively and selectively inserted in by the conducting terminals 12. Each one of the arced holes 331 has an inner edge and an outer edge. The locating pieces 333 are E-shaped in cross section, and are mounted on the bottom of the second indentation 33 and in the circle at which the arced holes 331 are located. Each one of the locating pieces 333 is adjacent to a corresponding arced hole 331, and has an inner slot and an outer slot formed in one side of the locating piece 333. Each pair of the arced holes 331 is located between two of the locating pieces 333 with the sides having the inner slot and the outer slot facing each other. Each one of the plate guides 334 is mounted on the bottom of the second indentation 33 and between two of the locating pieces 333 with the sides having the inner slot and outer slot facing each other, and has two parallel walls. The stoppers 337 are formed on the bottom of the second indentation 33 and are adjacent to the ground hole 336.

Each one of the intermediate conducting clip assemblies is mounted between two of the locating pieces 333 with the sides having the inner slot and outer slot facing each other, and has an outer conducting plate 34 and an inner conducting plate 35. The outer conducting plate 34 and the inner conducting plate 35 are arc-shaped, are electrically conductive, and are mounted on the bottom of the second indentation 33. The shapes of the outer conducting plates 34 and the inner conducting plates 35 correspond to that of a sidewall of the second indentation 33. The outer conducting plate 34 aligns with the outer edges of the arced holes 331 between two corresponding locating pieces 333. The inner conducting plate 35 aligns with the inner edges of the arced holes 331 between two corresponding locating pieces 333. The outer conducting plate 34 is closer to the sidewall of the second indentation 33 than the inner conducting plate 35. The inner conducting plates 35 has a lug 351 formed on the inner conducting plate 35. The lug 351 has a connection hole 352 formed through the lug 351. The inner conducting plate 35 is held in the inner slots of two corresponding locating pieces 333 with the sides having the inner slot and outer slot facing each other and mounted through the walls of a corresponding plate guide 334. The outer conducting plate 34 is held in outer slots of the corresponding locating pieces 333 and abuts the plate guide 334 between the corresponding locating pieces 333. Hence, the outer connection plate 34 and the inner connection plate 35 can be evenly spaced apart by the locating pieces 333 and the plate guide 334 and hold the conducting terminals 12 respectively mounted through the first arced hole of one pair of the arced holes 331 and the second arced hole of the other pair of the arced holes 331. The lug 351 of a corresponding inner conducting plate 35 is mounted on a top of one of the parallel walls of the plate guide 334 closer to the ground hole 336 to maintain the lug 351 at a height.

The intermediate ground assembly 36 is mounted on the second indentation 33, is adjacent to the ground hole 336, is fixed by the stoppers 337, and has a ground terminal holder 361 being U-shaped and electrically conductive, having two opposite conducting plates, and located above the bottom of the second indentation 33. The cylinder 32 has multiple engagement pieces 321, multiple engagement slots 322 and multiple protrusions 332. The engagement pieces 321 are formed on and protrude from a bottom end of a cylindrical surface of the cylinder 32. Each one of the engagement pieces 321 selectively aligns with and slides in a corresponding slidable groove 13 or a corresponding engagement recess 14. The engagement slots 322 are formed in the bottom of the cylinder 32, and each one of the engagement slots 322 is formed between two adjacent engagement pieces 321 and selectively aligns with and engages the engagement block 151 on the free end of the release tongue 15. In the present embodiment, the cylinder 32 has four engagement pieces 321 and four engagement slots 322. The protrusions 332 are formed on and protrude from a perimeter of the bottom of the second indentation 33 respectively at positions corresponding to the engagement slots 322.

The cover 40 is mounted on the base 30, and has two conducting pins 41 and a ground pin 42 serving for a three-pin plug (A). The conducting pins 41 and the ground pin 42 are mounted through a top of the cover 40. One end of each one of the conducting pins 41 and the ground pin 42 is mounted in the plug (A). The plug (A) in the first embodiment pertains to a Type B plug. Each one of the conducting pins 41 is blade-shaped, and has a live connection part 411 formed on the end of the conducting pin 41 into the plug (A). The live connection part 411 has a connection hole 412 formed through the live connection part 411. The live connection parts 411 of the conducting pins 41 are electrically and respectively connected with the lugs 351 on the inner conducting plates 35. The live connection parts 411 and the lugs 351 may be electrically and respectively connected with wires mounted through the connection holes 412, 352 of the live connection part 411 and the lug 351. The ground pin 42 is rod-shaped, and has a ground connection part 421 formed on the end of the ground pin 42 into the plug (A). The ground connection part 421 has a connection hole 422 formed through the ground connection part 421, and is electrically connected with the ground terminal holder 361 of the intermediate ground assembly 36. The ground connection part 421 may be directly and electrically connected with the ground terminal holder 361 of the intermediate ground assembly 36. The plug may have only two conducting pins 41 and no ground pin 42 in alternative embodiments.

Figure 4:
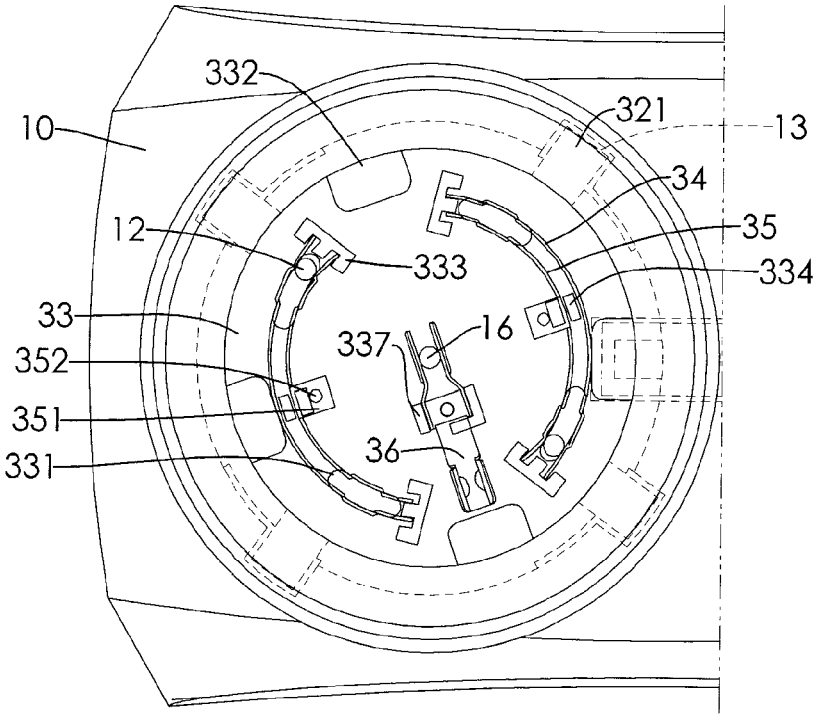
FIG. 4 is an enlarged operational top view of the power adapter in FIG. 1.
Figure 5:
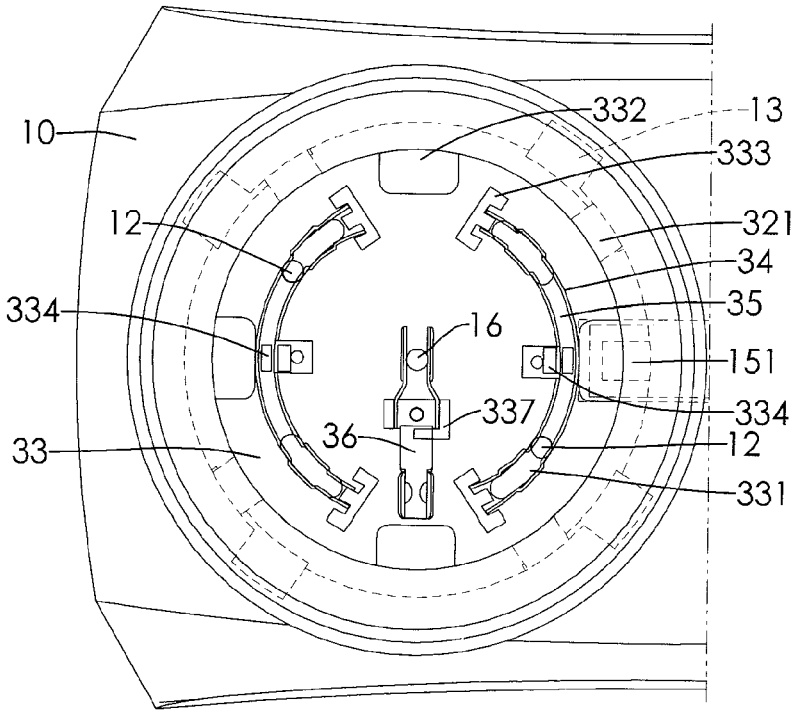
FIG. 5 is another enlarged operational top view of the power adapter in FIG. 1.
Figure 6:
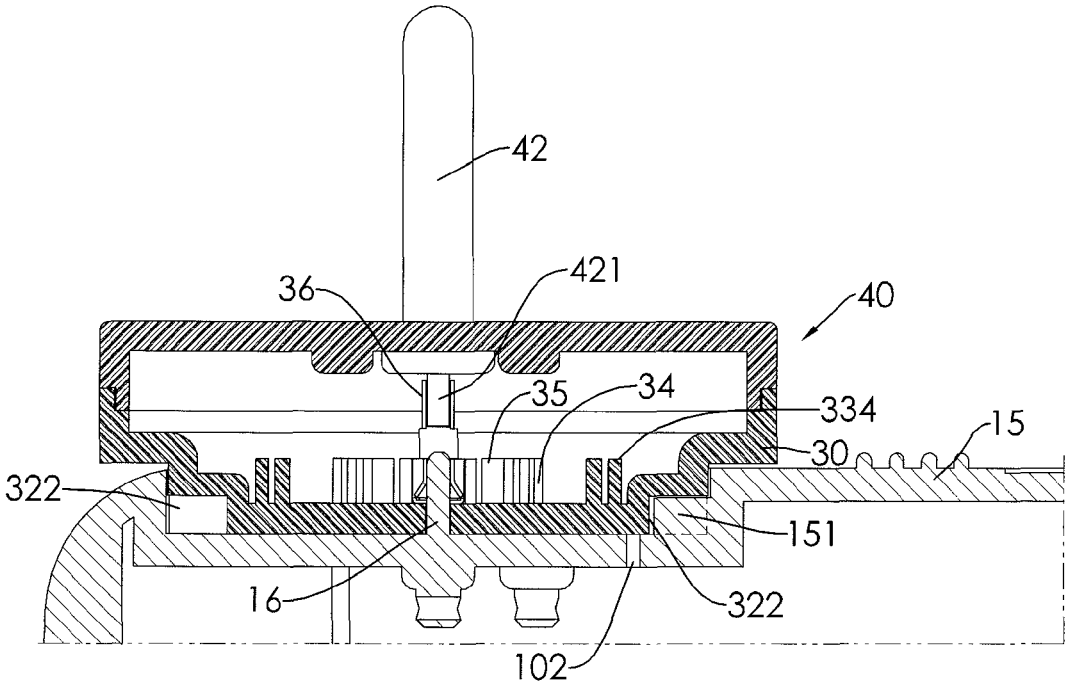
FIG. 6 is an enlarged side view in partial section of the power adapter in FIG. 1.

With reference to FIG. 4, when the power adapter in accordance with the present invention is assembled, the engagement pieces 321 on the cylinder 32 of the base 30 of the plug (A) are respectively mounted into the slidable grooves 13 of the body 10 so that the cylinder 32 of the base 30 of the plug (A) is inserted into the first indentation 11, the ground terminal 16 is inserted into the ground hole 336 of the base 30, the conducting terminals 12 are inserted into the first arced hole of one pair of the arced holes 331 and the second arced hole of the other pair of the arced holes 331, and each one of the conducting terminals 12 is held between the outer conducting plate 34 and the inner conducting plate 35 of a corresponding intermediate conducting clip assembly. With reference to FIGS. 3, 5 and 6, the plug (A) is rotated so that the engagement pieces 321 are respectively and slidably moved from the slidable grooves 13 into the engagement recesses 14, and the engagement block 151 on the release tongue 15 engages one of the engagement slots 322 of the cylinder 32. Accordingly, the plug (A) is locked on the body 10 and is restricted from rotating. Meanwhile, each one of the conducting terminals 12 is moved to abut against a corresponding locating piece 333 adjacent to the arced hole 331 in which the conducting terminal 12 is located to complete the mounting of the plug (A).

The plug (A) can be disassembled and removed from the body 10 by reversely performing the foregoing procedures. The release tongue 15 is pressed down so that the engagement block 151 is moved downwardly and disengages from the engagement slot 322, the plug (A) is made rotatable, and the engagement pieces 321 initially and respectively in the engagement recesses 14 are moved to the slidable grooves 13. The plug (A) can then be removed from the body by lifting the plug (A) upwardly and replaced with a plug having a different specification.

Figure 7:
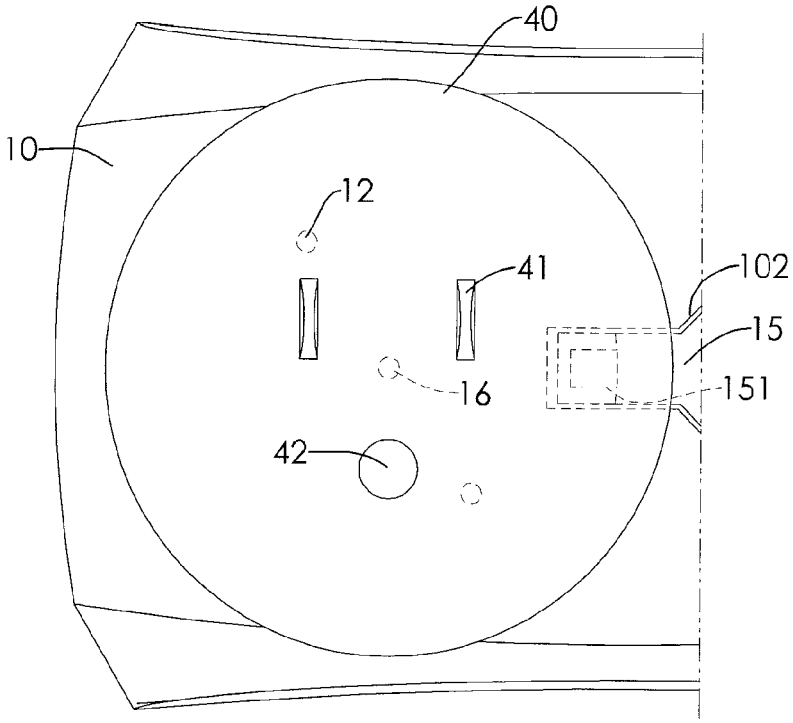
FIG. 7 is an enlarged operational top view of the power adapter in FIG. 1.
Figure 8:
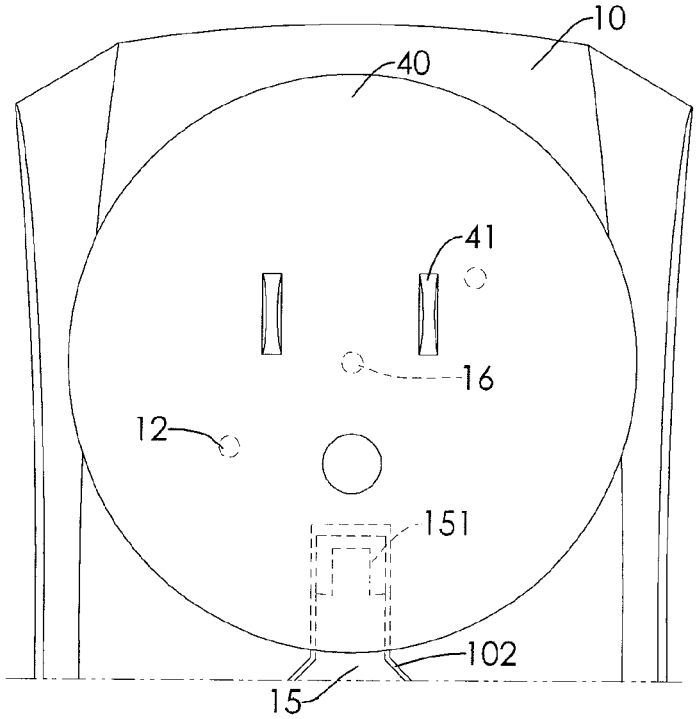
FIG. 8 is another enlarged operational top view of the power adapter in FIG. 1.

With reference to FIGS. 3, 7 and 8, when a plug (A) is mounted, the engagement pieces 321 respectively engage the slidable grooves 13 so as to position the conducting pins 41 and the ground pin 42 relative to the body 10. Hence, the plug (A) can be positioned relative to the body 10 at different relative positions and angles to keep the body 10 from blocking other plug holes of the power adapter and to make the other plug holes of the power adapter available to be plugged in by other plugs.

The following embodiments differ from the first embodiment in the plug only.

Figure 9:
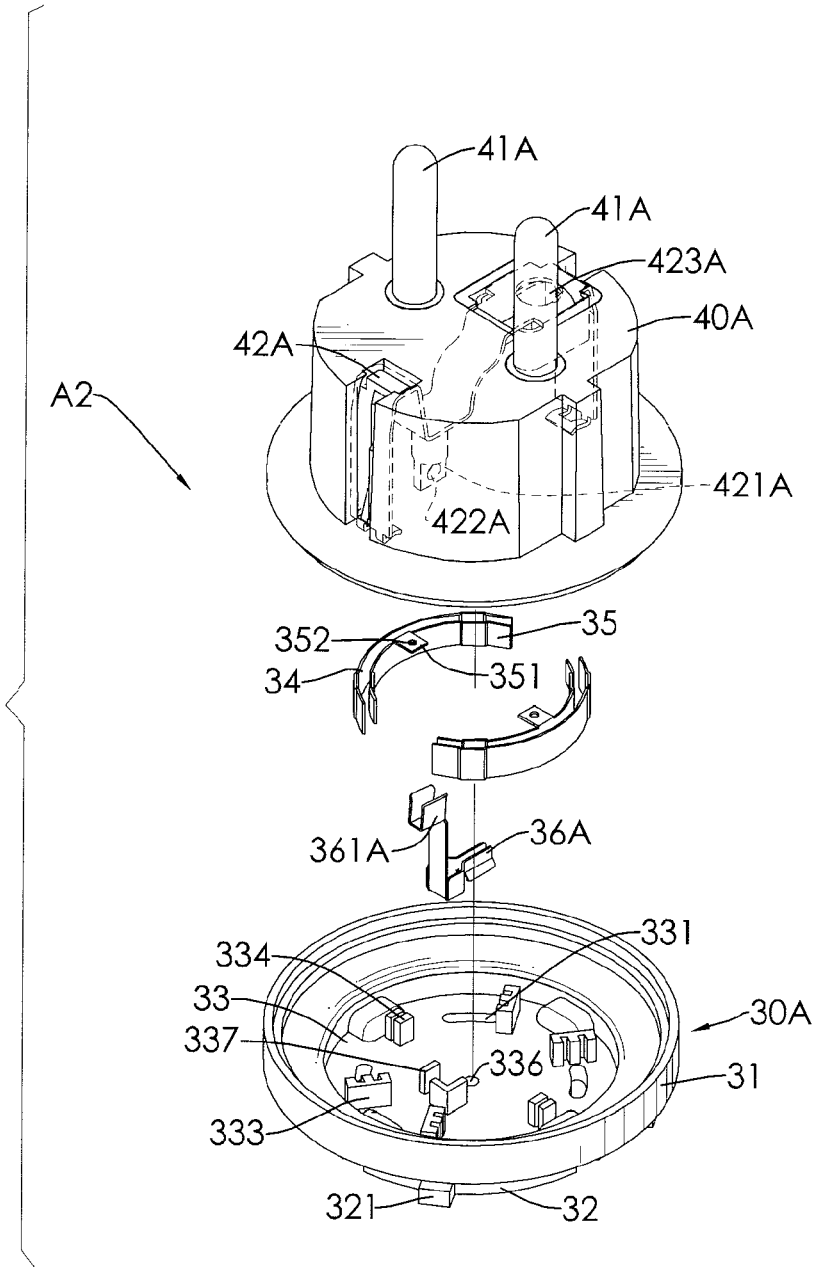
FIG. 9 is an exploded perspective view of a second embodiment of a plug of a power adapter having a replaceable and positionable plug in accordance with the present invention.

With reference to FIG. 9, a second embodiment of a power adapter in accordance with the present invention is shown. The plug (A2) shown in FIG. 9 pertains to a type G plug. The plug (A2) is cylindrical. Except that the ground terminal holder 361A of the intermediate ground assembly 36A of the base 30A of the plug (A2) is higher than the ground terminal holder 361 of the intermediate ground assembly 36 in the first embodiment, the rest of parts of the base 30A are identical to those of the base 30 in the first embodiment. The cover 40A is also higher than the cover 40 in the first embodiment, and the cover 40A is cylindrical. The two conducting pins 41A are rod-shaped. One end of each one of the conducting pins 41A facing the second indentation 33 and electrically connected with the lug 351 of a corresponding inner conducting plate 35 is structurally identical to that of the conducting pin 41 in the first embodiment. The ground pin 42A takes a form of a curved plate, is partially mounted on a top and a cylindrical surface of the cover 40A, and has a ground hole 423A and a ground connection part 421A. The ground hole 423A is formed through the ground pin 42A at the top of the ground pin 42A. The ground connection part 421A is formed on one end facing the second indentation 33. The ground connection part 421A has a connection hole 422A, and the ground terminal holder 361 of the intermediate ground assembly 36 can be directly and electrically connected with the ground connection part 421A of the ground pin 42A.

Figure 10:
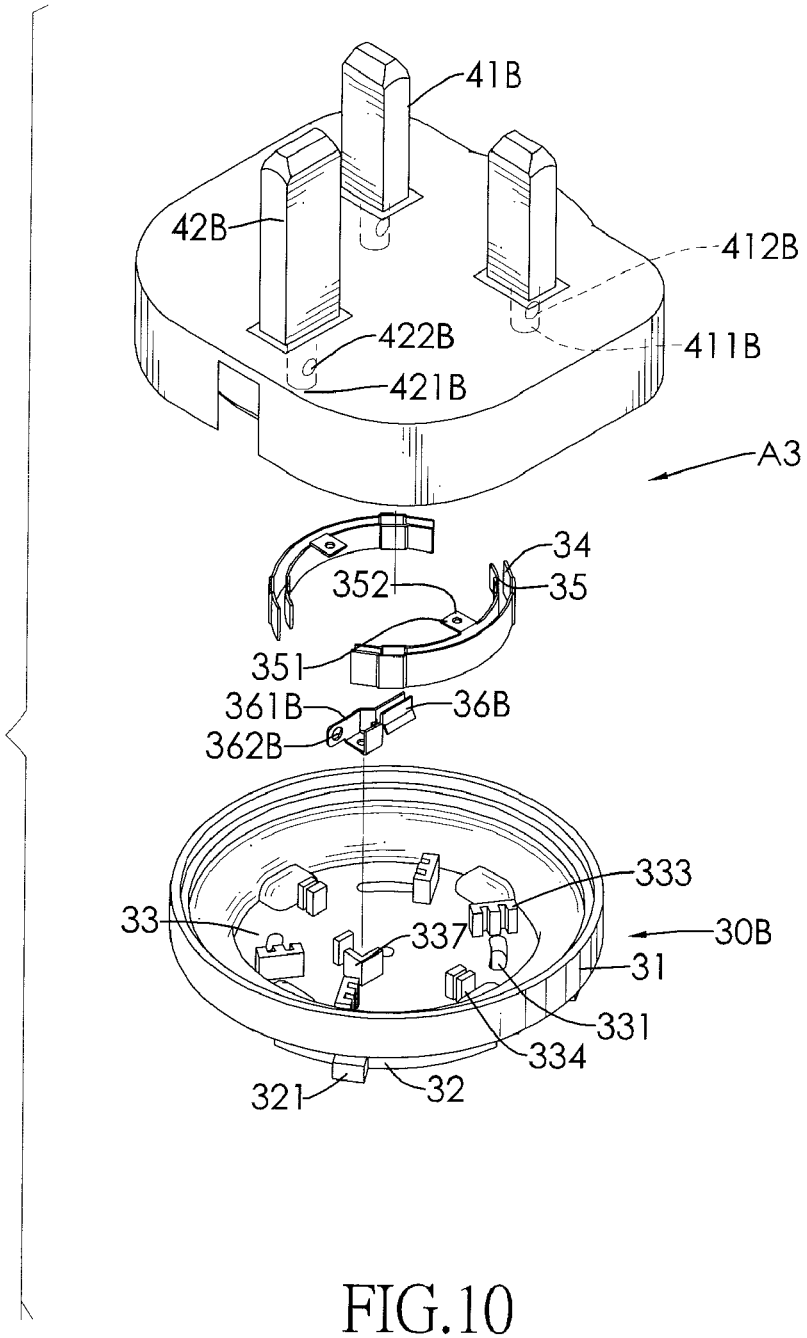
FIG. 10 is an exploded perspective view of a third embodiment of a plug of a power adapter having a replaceable and positionable plug in accordance with the present invention.

With reference to FIG. 10, a third embodiment of a power adapter in accordance with the present invention is shown. The plug (A3) shown in FIG. 10 pertains to a type I plug. The plug (A3) takes a form of a rounded rectangular block. Except that the ground terminal holder 361B of the intermediate ground assembly 36B in the base 30B of the plug (A3) has only one conducting plate 361, the ground terminal holder 361B is perpendicularly mounted on the bottom of the second indentation 33, the ground terminal holder 361B is lower than that in the first embodiment, and the ground terminal holder 361B has a through hole 362B, the rest of parts of the base 30B are identical to those of the base 30 in the first embodiment. In the third embodiment, each one of the conducting pins 41B takes a form of a rectangular column and has a live connection part 411B formed on one end of each one of the conducting pins 41B facing the second indentation 33. The live connection part 411B has a connection hole 412B formed through the live connection part 411B. The ground pin 42B also takes a form of a rectangular column, and has a ground connection part 421B formed on one end of the ground pin 42B facing the second indentation 33. The ground connection part 421B has a connection hole 422B formed through the ground connection part 421B. The live connection part 411B of each one of the conducting pins 41B is electrically connected with the lug 351 of a corresponding inner conducting plate 35 with a wire. The ground connection part 421B of the ground pin 42B is electrically connected with ground terminal holder 361B of the intermediate ground assembly 36B with a wire.

Figure 11:
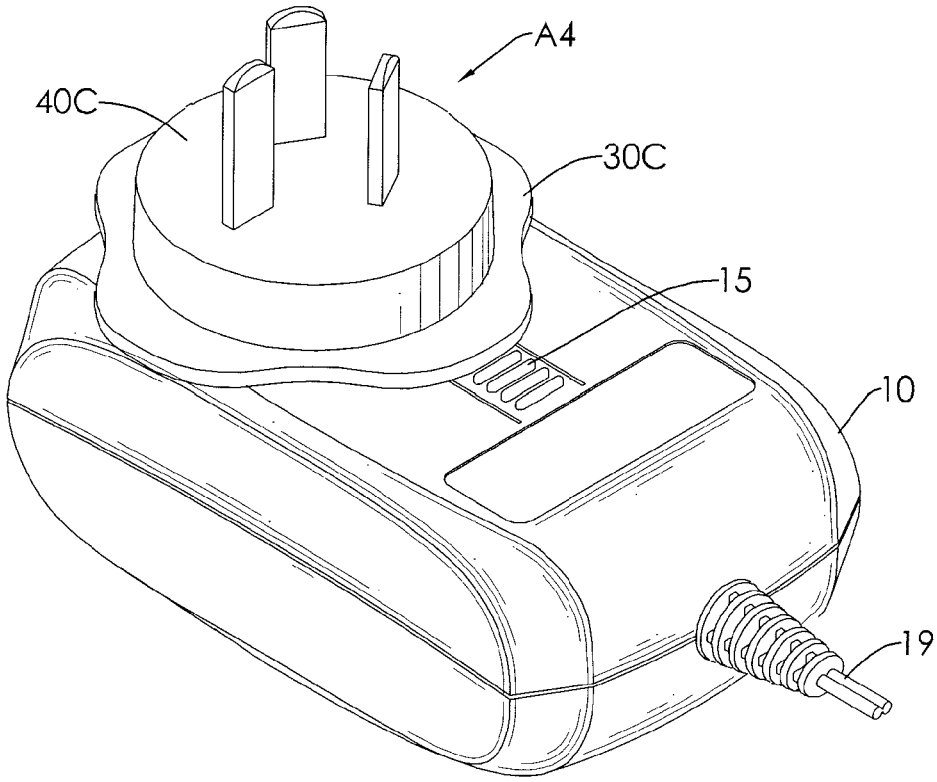
FIG. 11 is a perspective view of a fourth embodiment of a power adapter having a replaceable and positionable plug in accordance with the present invention.
Figure 12:
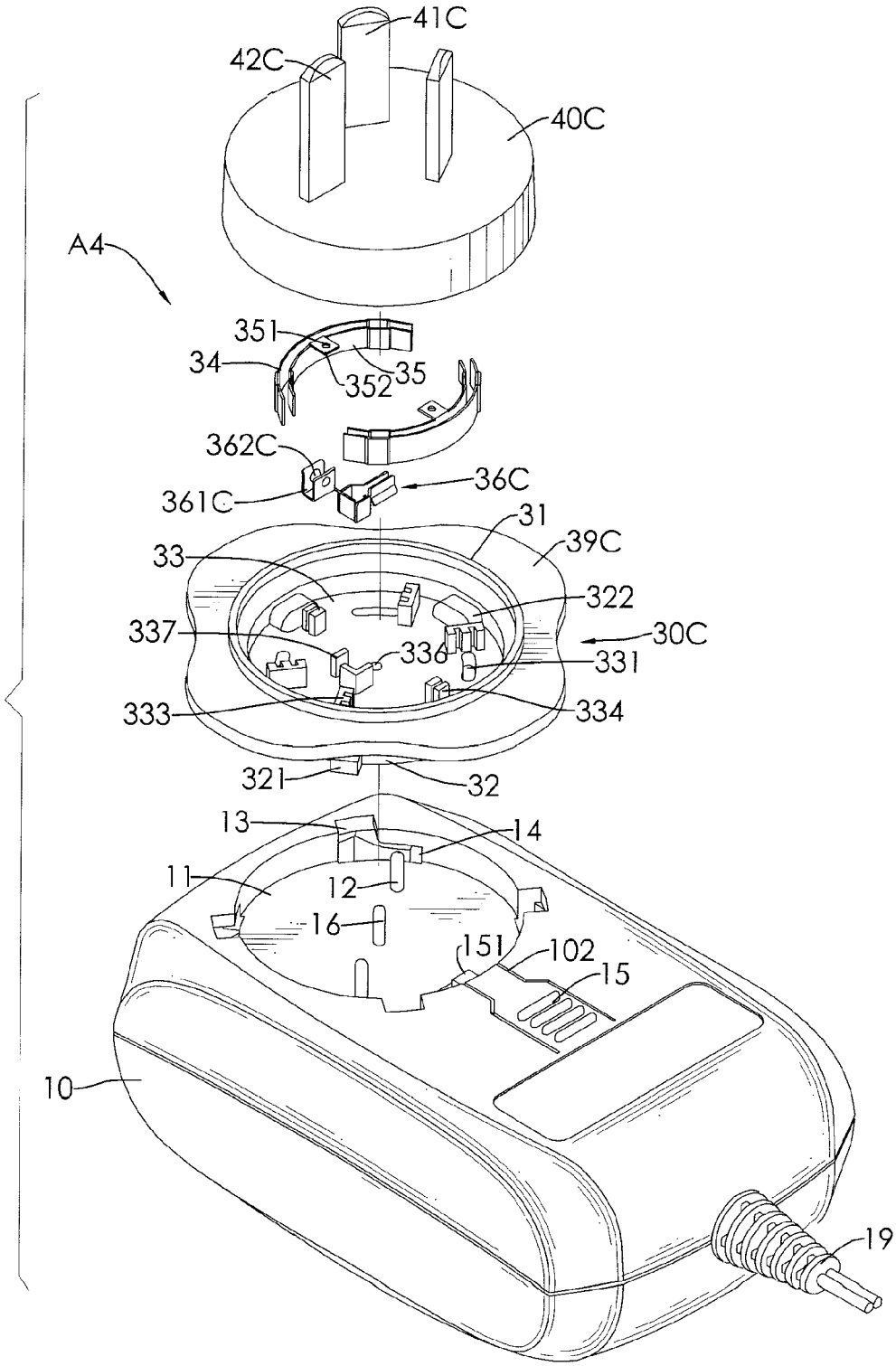
FIG. 12 is an exploded perspective view of the power adapter in FIG. 11.

With reference to FIGS. 11 and 12, a fourth embodiment of a power adapter in accordance with the present invention is shown. The plug shown in FIGS. 11 and 12 pertains to a type D plug. Except that a flower-shaped plate 39C is formed on and protrudes horizontally from the fence 31, and each one of the two opposite conducting plates of the ground terminal holder 361C of the intermediate ground assembly 36C has a through hole 362C formed through the ground terminal holder 361C, the rest of parts of the base 30C are identical to those of the base 30 in the first embodiment. The two conducting pins 41C are blade-shaped. The structure of one end of each one of the conducting pins 41C facing the second indentation 33 and electrically connected with the lug 351 of a corresponding inner conducting plate is structurally identical to that of the conducting pin 41 in the first embodiment. The ground pin 42C is blade-shaped. The structure of one end of the ground pin 42C facing the second indentation 33 and electrically connected with the lug 351 of a corresponding inner conducting plate 35 is structurally identical to that of the ground pin 42 in the first embodiment.

When the plug (A) is assembled with the body 10, the ground terminal 16 and the conducting terminals 12 are respectively inserted into the ground hole 336 and two corresponding arced holes 331, and the conducting terminals 12 are respectively and electrically connected with the conducting pins 41 through the intermediate conducting clip assemblies regardless of which arced holes 331 are inserted in by the conducting terminals 12. Meanwhile, the engagement pieces 321 on the cylinder 32 of the base 30 of the plug (A) respectively and selectively slide into the slidable grooves 13 and the engagement recesses 14 of the body 10, so that the plug (A) can be selectively oriented as desired. Additionally, the plug (A) having two pins or three pins in compliance with different plug specifications can be assembled with the body 10. Accordingly, the plug (A) is positionable and replaceable. Even though the body 10 is positioned again in use, the body 10 does not block plug holes and prevent other plugs from being plugged in.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A power adapter having a replaceable and positionable plug, the adapter comprising:

a body having:

a top;

a bottom;

a first indentation circularly formed in the top of the body and having a bottom and a sidewall;

a ground terminal mounted on the bottom of the first indentation and being electrically conductive; and two conducting terminals mounted on the bottom of the first indentation, and being electrically conductive; and a plug being hollow and having:

a top;

a bottom;

a cylinder formed on and protruding from the bottom of the plug, received in the first indentation, and having a bottom and a cylindrical surface;

a ground hole formed through the cylinder and inserted in by the ground terminal of the body;

multiple arced holes formed through the bottom of the cylinder, and arranged in a circle with respect to the ground hole, wherein two of the arced holes are selectively inserted in by the conducting terminals;

two intermediate conducting clip assemblies mounted inside the plug, and respectively and electrically connected with the conducting terminals of the body; and two conducting pins formed through the top of the plug, wherein one end of each one of the conducting pins is mounted in the plug to electrically connect with one of the intermediate conducting clip assemblies.

2. The power adapter as claimed in claim 1, wherein the body further has multiple slidable grooves formed in the sidewall of the first indentation, and each one of the slidable grooves has an engagement recess formed in one end of the slidable groove; and the cylinder of the plug further has multiple engagement pieces formed on and protruding from the cylindrical surface of the cylinder, and each one of the engagement pieces is selectively mounted in one of the slidable grooves and a corresponding engagement recess.

3. The power adapter as claimed in claim 2, wherein the plug further has:

an intermediate ground assembly mounted in the plug and being electrically conductive; and a ground pin mounted through the top of the plug and being electrically conductive, wherein one end of the ground pin is mounted in the plug to electrically connect with the intermediate ground assembly.

4. The power adapter as claimed in claim 2, wherein the plug has:

a base having:

a top;

a fence annularly formed on and protruding from a perimeter of the top of the base;

a second indentation formed in the top of the base and recessed into the cylinder, and having a bottom and a sidewall, the ground hole and the arced holes, wherein the ground hole is formed through the bottom of the second indentation, the intermediate conducting clip assemblies are mounted on the bottom of the second indentation, each one of the intermediate conducting clip assemblies has an outer conducting plate and an inner conducting plate being arc-shaped and electrically conductive, and each one of the outer conducting plates and each one of the inner conducting plates are mounted on the bottom of the second indentation and respectively outside and inside two corresponding arced holes; and a cover mounted on the base and having two conducting pins formed through the cover, wherein one end of each one of the conducting pins facing the second indentation has a connection part formed on the end of the conducting pin.

5. The power adapter as claimed in claim 4, wherein the second indentation further has an intermediate ground assembly mounted on the second indentation of the base and being electrically conducting; and the cover further has a ground pin mounted through the cover, being electrically conductive, and having a connection part formed on one end of the ground pin facing the second indentation of the base.

6. The power adapter as claimed in claim 5, wherein the second indentation further has:

four arced holes grouped as two pairs, wherein each pair of the arced holes has a first arced hole and a second arced hole, the first arced hole of one pair of the arced holes and the second arced hole of the other pair of the arced holes are oppositely located, and are respectively and selectively inserted in by the conducting terminals;

four locating pieces being E-shaped, wherein each one of the locating pieces is adjacent to one end of a corresponding arced hole and has an inner slot and an outer slot formed in one side of the locating piece, and each pair of the arced holes is located between two corresponding locating pieces with the sides having the inner slot and the outer slot facing each other;

two plate guides, wherein each one of the plate guides is mounted on the bottom of the second indentation and between two corresponding locating pieces with the sides having the inner slot and outer slot facing each other, and has two parallel walls; and two stoppers formed on the bottom of the second indentation and being adjacent to the ground hole;

each one of the intermediate conducting clip assemblies is mounted between two corresponding locating pieces with the sides having the inner slot and outer slot facing each other and has an outer conducting plate and an inner conducting plate, shapes of the outer conducting plate and the inner conducting plate correspond to that of a sidewall of the second indentation, the outer conducting plate is closer to the sidewall of the second indentation than the inner conducting plate, the outer conducting plate aligns with the outer edges of the arced holes between two corresponding locating pieces, the inner conducting plate aligns with inner edges of the arced holes between two corresponding locating pieces, the inner conducting plate is held in the inner slots of two corresponding locating pieces with the sides having the inner slot and the outer slot facing each other and mounted in a corresponding plate guide, the outer conducting plate is held in the outer slots of the locating pieces and abuts a corresponding plate guide, and each one of the inner conducting plates has a lug formed thereon.

7. The power adapter as claimed in claim 6, wherein the intermediate ground assembly has a ground terminal holder being U-shaped and electrically conductive, having two opposite conducting plates, and located above the bottom of the second indentation;

each one of the conducting pins is blade-shaped, and has a live connection part formed on the end of the conducting pin into the second indentation, and the live connection part has a connection hole formed therethrough, and is electrically and respectively connected with the lugs on the inner conducting plates with wires passing through the connection holes of the live connection part and the lug; and the ground pin is rod-shaped, and has a ground connection part formed on the end of the ground pin into the second indentation, the ground connection part has a connection hole formed therethrough, and is electrically connected with the ground terminal holder of the intermediate ground assembly.

8. The power adapter as claimed in claim 1, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

9. The power adapter as claimed in claim 2, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

10. The power adapter as claimed in claim 3, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

11. The power adapter as claimed in claim 4, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

12. The power adapter as claimed in claim 5, wherein the body further has a release tongue Formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

13. The power adapter as claimed in claim 6, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

14. The power adapter as claimed in claim 7, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

15. The power adapter as claimed in claim 6, wherein the intermediate ground assembly has a ground terminal holder being U-shaped and electrically conductive, having two opposite conducting plates, and located above the bottom of the second indentation;

each one of the conducting pins is rod-shaped, and has a live connection part formed on the end of the conducting pin facing the second indentation, and the live connection part has a connection hole formed therethrough, and is electrically and respectively connected with the lugs on the inner conducting plates with wires passing through the connection holes of the live connection part and the lug; and the ground pin takes a form of a curved plate, and has a ground connection part formed on the end of the ground pin into the second indentation, the ground connection part has a connection hole formed through a top of the ground pin, and is electrically connected with the ground terminal holder of the intermediate ground assembly.

16. The power adapter as claimed in claim 6, wherein the intermediate ground assembly has a ground terminal holder being electrically conductive, having a conducting plate, and located above the bottom of the second indentation;

each one of the conducting pins takes a form of a rectangular column, and has a live connection part formed on the end of the conducting pin into the second indentation, and the live connection part has a connection hole formed therethrough, and is electrically and respectively connected with the lugs on the inner conducting plates with wires passing through the connection holes of the live connection part and the lug; and the ground pin takes the form of the rectangular column, and has a ground connection part formed on the end of the ground pin into the second indentation, the ground connection part has a connection hole formed therethrough, and is electrically connected with the ground terminal holder of the intermediate ground assembly.

17. The power adapter as claimed in claim 6, wherein the intermediate ground assembly has a ground terminal holder being U-shaped and electrically conductive, having two opposite conducting plates, and located above the bottom of the second indentation, wherein each conducting plate has a through hole formed through the conducting plate;

each one of the conducting pins is blade-shaped, and has a live connection part formed on the end of the conducting pin into the second indentation, and the live connection part has a connection hole formed therethrough, and is electrically and respectively connected with the lugs on the inner conducting plates with wires passing through the connection holes of the live connection part and the lug; and the ground pin is blade-shaped, and has a ground connection part formed on the end of the ground pin into the second indentation, the ground connection part has a connection hole formed therethrough, and is electrically connected with the ground terminal holder of the intermediate ground assembly.

18. The power adapter as claimed in claim 15, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

19. The power adapter as claimed in claim 16, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

20. The power adapter as claimed in claim 17, wherein the body further has a release tongue formed by cutting two slits located on the top of the body and extending the slits to meet on the bottom of the first indentation so as to form a free end inside the first indentation, and the release tongue has an engagement block formed on and protruding from the bottom and the sidewall of the first indentation; and the cylinder further has multiple engagement slots formed in the bottom of the cylinder, and each one of the engagement slots is formed between two adjacent engagement pieces and selectively aligns with and engages the engagement block on the free end of the release tongue.

* * * * *